US007510612B2

(12) United States Patent
Matsukawa et al.

(10) Patent No.: US 7,510,612 B2
(45) **Date of Patent: *Mar. 31, 2009**

(54) CHEMICAL CONVERSION COATING AGENT AND SURFACE-TREATED METAL

(75) Inventors: Masahiko Matsukawa, Nishitokyo (JP); Kazuhiro Makino, Yokohama (JP); Toshiaki Shimakura, Ichikawa (JP)

(73) Assignee: Nippon Paint Co., Ltd., Kita-ku, Osaka (JP)

( * ) Notice: Subject to any disclaimer, the term of this patent is extended or adjusted under 35 U.S.C. 154(b) by 283 days.

This patent is subject to a terminal disclaimer.

(21) Appl. No.: 10/743,386

(22) Filed: Dec. 23, 2003

(65) Prior Publication Data

US 2004/0163735 A1 Aug. 26, 2004

(30) Foreign Application Priority Data

| | | | |
|---|---|---|---|
| Dec. 24, 2002 | (JP) | ..... | 2002-372769 |
| Dec. 24, 2002 | (JP) | ..... | 2002-372770 |
| Dec. 2, 2003 | (JP) | ..... | 2003-403692 |

(51) Int. Cl.

| | |
|---|---|
| ***C23C 22/34*** | (2006.01) |
| ***C23C 22/80*** | (2006.01) |
| *C23C 22/50* | (2006.01) |
| *C23C 22/56* | (2006.01) |

(52) U.S. Cl. ..... 148/247; 148/243; 148/274; 106/14.05; 106/14.11; 106/14.15; 106/14.41; 106/14.42; 106/14.44

(58) Field of Classification Search ..... 148/243, 148/247, 259, 274; 106/14.12, 14.15, 14.44, 106/14.11, 14.05, 14.41, 14.42
See application file for complete search history.

(56) References Cited

U.S. PATENT DOCUMENTS

| | | | | |
|---|---|---|---|---|
| 5,614,585 | A * | 3/1997 | Matsukawa et al. | 524/608 |
| 6,312,812 | B1 * | 11/2001 | Hauser et al. | 428/412 |
| 6,607,610 | B1 | 8/2003 | Carey et al. | |
| 2003/0150524 | A1 | 8/2003 | Wichelhaus et al. | |
| 2004/0144451 | A1 * | 7/2004 | Matsukawa et al. | 148/247 |
| 2004/0168748 | A1 * | 9/2004 | Hartwig et al. | 148/247 |
| 2005/0126427 | A1 * | 6/2005 | Gonzalez et al. | 106/1.16 |

FOREIGN PATENT DOCUMENTS

| | | | |
|---|---|---|---|
| CN | 1321709 | | 11/2001 |
| DE | 199 33 189 | A1 | 1/2001 |
| DE | 101 43 521 | A1 | 10/2002 |
| JP | 7-310189 | | 11/1995 |
| JP | 10-204649 | | 8/1998 |
| JP | 2002-060699 | | 2/2001 |
| JP | 2001-348674 | | 12/2001 |
| JP | 2002 275642 | | 9/2002 |
| JP | 2002-275642 | * | 9/2002 |
| JP | 2002-275648 | A | 9/2002 |
| WO | WO-01 66827 | | 9/2001 |
| WO | WO-01 86016 | A2 | 11/2001 |
| WO | WO-02 20652 | A1 | 3/2002 |
| WO | WO-02/090619 | A2 | 11/2002 |
| WO | WO 03/056062 | * | 7/2003 |

* cited by examiner

*Primary Examiner*—Roy King
*Assistant Examiner*—Lois Zheng
(74) *Attorney, Agent, or Firm*—Connolly Bove Lodge & Hutz LLP

(57) ABSTRACT

The present invention disclosure provides a chemical conversion coating agent which places a less burden on the environment and can apply good chemical conversion treatment to all metals such as iron, zinc and aluminum, and a surface-treated metal obtained using the same. The chemical conversion coating agent comprising: at least one kind selected from the group consisting of zirconium, titanium and hafnium; fluorine; and a water-soluble resin, wherein said water-soluble resin has, in at least a part thereof, a constituent unit expressed by the chemical formula (1):

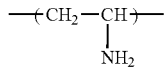

(1)

and/or the chemical formula (2):

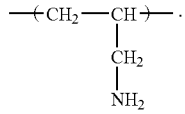

(2)

12 Claims, No Drawings

CHEMICAL CONVERSION COATING AGENT AND SURFACE-TREATED METAL

TECHNICAL FIELD

The present invention relates to a chemical conversion coating agent and a surface-treated metal.

BACKGROUND ART

When a cationic electrocoating or a powder coating is applied to the surface of a metal material, a chemical conversion treatment is generally applied in order to improve the properties such as corrosion resistance and adhesion to a coating film. With respect to a chromate treatment used in the chemical conversion treatment, from the viewpoint of being able to further improve the adhesion to a coating film and the corrosion resistance, in recent years, a harmful effect of chromium has been pointed and the development of a chemical conversion coating agent containing no chromium is required. As such a chemical conversion treatment, a treatment using zinc phosphate is widely adopted (cf. Japanese Kokai Publication Hei-10-204649, for instance).

However, since treating agents based on zinc phosphate have high concentrations of metal ions and acids and are very active, these are economically disadvantageous and low in workability in a wastewater treatment. Further, there is a problem of formation and precipitation of salts, being insoluble in water, associated with the metal surface treatment using treating agents based on zinc phosphate. Such a precipitated substance is generally referred to as sludge and increases in cost for removal and disposal of such sludge become problems. In addition, since phosphate ions have a possibility of placing a burden on the environment due to eutrophication, it takes efforts for treating waste water; therefore, it is preferably not used. Further, there is also a problem that in a metal surface treatment using treating agents based on zinc phosphate, a surface conditioning is required; therefore, a treatment process become long.

As a metal surface treating agent other than such a treating agent based on zinc phosphate or a chemical conversion coating agent of chromate, there is known a metal surface treating agent comprising a zirconium compound (cf. Japanese Kokai Publication Hei-07-310189, for instance). Such a metal surface treating agent comprising a zirconium compound has an excellent property in point of suppressing the generation of the sludge in comparison with the treating agent based on zinc phosphate described above.

However, a chemical conversion coat attained by the metal surface treating agent comprising a zirconium compound is poor in the adhesion to a coating film attained by the cationic electrocoating or the powder coating, and usually less used as a pretreatment for these coating techniques. Particularly in such a metal surface treating agent comprising a zirconium compound, efforts to improve the adhesion and the corrosion resistance by using it in conjunction with another component such as phosphate ions are being made. However, when it is used in conjunction with the phosphate ions, a problem of the eutrophication will arise as described above. In addition, there has been no study on using such treatment using a metal surface treating agent as a pretreatment method for coating. Further, there was a problem that when an iron material was treated with such the metal surface treating agent, the adequate adhesion to a coating film and the corrosion resistance after coating could not be attained.

As a metal surface treating agent containing a zirconium compound with the above-described problems improved, a metal surface treating agent containing no phosphate ion and comprising a zirconium compound, vanadium and resin has been developed (cf. Japanese Kokai Publication 2002-60699, for instance). However, since such a metal surface treating agent contains vanadium, it is not preferable in point of causing a problem of a harmful effect on human body and wastewater treatment.

Further, surface treatment of all metals have to be performed by one step of treatment to articles including various metal materials such as iron, zinc and aluminum for bodies and parts of automobiles in some cases. Accordingly there is desired the development of a chemical conversion coating agent which can apply a chemical conversion treatment without problems even in such a case.

SUMMARY OF THE INVENTION

In consideration of the above circumstances, it is an object of the present invention to provide a chemical conversion coating agent which places a less burden on the environment and can apply good chemical conversion treatment to all metals such as iron, zinc and aluminum, and a surface-treated metal obtained using the same.

The present invention is directed to a chemical conversion coating agent comprising:

at least one kind selected from the group consisting of zirconium, titanium and hafnium;

fluorine; and a water-soluble resin, wherein said water-soluble resin has, in at least a part thereof, a constituent unit expressed by the chemical formula (1):

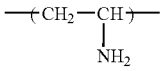

(1)

and/or the chemical formula (2):

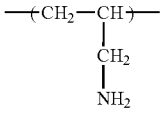

(2)

Preferably, the water-soluble resin is a polyvinylamine resin or a polyallylamine resin.

Preferably, the water-soluble resin has a molecular weight of 500 to 500000, and a content of the water-soluble resin in the chemical conversion coating agent is 5 to 5000 ppm.

Preferably, the chemical conversion coating agent contains 1 to 5000 ppm of at least one kind of a chemical conversion reaction accelerator selected from the group consisting of nitrite ion, nitro group-containing compounds, hydroxylamine sulfate, persulfate ion, sulfite ion, hyposulfite ion, peroxides, iron (III) ion, citric acid iron compounds, bromate ion, perchlorinate ion, chlorate ion, chlorite ion, as well as ascorbic acid, citric acid, tartaric acid, malonic acid, succinic acid and salts thereof.

Preferably, the at least one kind selected from the group consisting of zirconium, titanium and hafnium has a content of 20 to 10000 ppm in terms of metal, and the chemical conversion coating agent has a pH of 1.5 to 6.5.

The present invention is directed to a surface-treated metal comprising a chemical conversion coat formed by the chemical conversion coating agent.

Preferably, the chemical conversion coat has a coat amount of 0.1 to 500 mg/$m^2$ in a total amount of metals contained in the chemical conversion coating agent.

DETAILED DESCRIPTION OF THE INVENTION

Hereinafter, the present invention will be described in detail.

The present invention is directed to a chemical conversion coating agent which contains at least one kind selected from the group consisting of zirconium, titanium and hafnium as well as fluorine, and substantially contains no harmful heavy metal ions such as chromium and vanadium and phosphate ions.

When a surface of metal was treated with a conventionally known chemical conversion coating agent containing zirconium and the like, it was sometimes impossible to form a good chemical conversion coat in some metals. Particularly, there was a problem that when an iron material was treated with the above-mentioned chemical conversion coating agent, the adequate adhesion between a coating film to be formed by applying coating to the surface of the chemical conversion coat and the surface of metal, and the corrosion resistance after coating could not be attained. The present invention has been accomplished by finding that the above-mentioned problem would be improved by the chemical conversion coating agent containing a specific resin component.

At least one kind selected from the group consisting of zirconium, titanium and hafnium contained in the chemical conversion coating agent is a component constituting chemical conversion coats and, by forming a chemical conversion coat including at least one kind selected from the group consisting of zirconium, titanium and hafnium on a material, the corrosion resistance and abrasion resistance of the material can be improved and, further, the adhesion to the coating film formed subsequently can be enhanced.

A supply source of the zirconium is not particularly limited, and examples thereof include alkaline metal fluoro-zirconate such as $K_2ZrF_6$, fluoro-zirconate such as $(NH_4)_2ZrF_6$, soluble fluoro-zirconate like fluoro-zirconate acid such as $H_2ZrF_6$, zirconium fluoride, zirconium oxide and the like.

A supply source of the titanium is not particularly limited, and examples thereof include alkaline metal fluoro-titanate, fluoro-titanate such as $(NH_4)_2TiF_6$, soluble fluoro-titanate like fluoro-titanate acid such as $H_2TiF_6$, titanium fluoride, titanium oxide and the like.

A supply source of the hafnium is not particularly limited, and examples thereof include fluoro-hafnate acid such as $H_2HfF_6$, hafnium fluoride and the like.

As a supply source of at least one kind selected from the group consisting of zirconium, titanium and hafnium, a compound having at least one kind selected from the group consisting of $ZrF_6^{2-}$, $TiF_6^{2-}$ and $HfF_6^{2-}$ is preferable because of high ability of forming a coat.

Preferably, the content of at least one kind selected from the group consisting of zirconium, titanium and hafnium, which is contained in the chemical conversion coating agent is within a range from 20 ppm of a lower limit to 10000 ppm of an upper limit in terms of metal. When the content is less than the above lower limit, the performance of the chemical conversion coat to be obtained is inadequate, and when the content exceeds the above upper limit, it is economically disadvantageous because further improvements of the performances cannot be expected. More preferably, the lower limit is 50 ppm and the upper limit is 2000 ppm.

Fluorine contained in the chemical conversion coating agent plays a role as an etchant of a material. A supply source of the fluorine is not particularly limited, and examples thereof include fluorides such as hydrofluoric acid, ammonium fluoride, fluoboric acid, ammonium hydrogenfluoride, sodium fluoride, sodium hydrogenfluoride and the like. In addition, an example of complex fluoride includes hexafluorosilicate, and specific examples thereof include hydrosilicofluoric acid, zinc hydrosilicofluoride, manganese hydrosilicofluoride, magnesium hydrosilicofluoride, nickel hydrosilicofluoride, iron hydrosilicofluoride, calcium hydrosilicofluoride and the like.

The water-soluble resin used in the chemical conversion coating agent of the present invention is a water-soluble resin having, in at least a part thereof, a constituent unit expressed by the chemical formula (1):

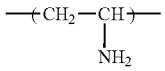

(1)

and/or the chemical formula (2):

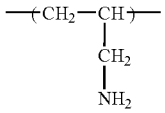

(2)

It is considered that the chemical conversion coat high in the adhesion to a metal material and a coating film is obtained by the action of an amino group contained in the water-soluble resin. A method of producing the water-soluble resin is not specifically limited, and it can be produced by a publicly known method.

Preferably, the water-soluble resin is a polyvinylamine resin, which is a polymer comprising only a constituent unit expressed by the above formula (1), and/or a polyallylamine resin, which is a polymer comprising only a constituent unit expressed by the above formula (2). The polyvinylamine resin and polyallylamine resin are particularly preferable in point of having a high degree of effect of improving the adhesion. The polyvinylamine resin is not specifically limited, and commercially available polyvinylamine resins such as PVAM-0595B (manufactured by Mitsubishi Chemical Co., Ltd.) can be used. The polyallylamine resin is not specifically limited, and, for example, commercially available polyallylamine resins such as PAA-01, PAA-10C, PAA-H-10C and PAA-D-11-HCl (each manufactured by Nitto Boseki Co., Ltd.) can be used. Further, the polyvinylamine resin and the polyallylamine resin may be used in combination.

As the water-soluble resin, within the scope of not impairing the object of the present invention, there can also be used a substance formed by modifying a part of amino groups of the polyvinylamine resin and/or polyallylamine resin by methods of acetylating and the like, a substance formed by neutralizing a part of or all of amino groups of the polyvinylamine resin and/or polyallylamine resin with acid, and a substance formed by crosslinking a part of or all of amino groups of the polyvinylamine resin and/or polyallylamine resin with a crosslinking agent within the scope of not affecting the solubility of the resin.

Preferably, the water-soluble resin has an amino group having an amount within a range from 0.01 mole of a lower limit to 2.3 moles of an upper limit per 100 g of the resin. When the amount of the amino group is less than 0.01 mole, it is not preferable because the adequate effect cannot be attained. When it exceeds 2.3 moles, there is a possibility that the objective effect cannot be attained. More preferably, the above-mentioned lower limit is 0.1 mole.

Preferably, the content of the water-soluble resin in the chemical conversion coating agent of the present invention is within a range from 5 ppm of a lower limit to 5000 ppm of an upper limit as a concentration of solid matter. When the content is less than 5 ppm, it is not preferable because the chemical conversion coat having the adequate adhesion to a coating film cannot be attained. When it exceeds 5000 ppm, there is a possibility of inhibiting coat formation. More preferably, the above-mentioned lower limit is 10 ppm and the above-mentioned upper limit is 500 ppm.

Preferably, the water-soluble resin has a molecular weight within a range from 500 of a lower limit to 500000 of an upper limit. When the molecular weight is less than 500, it is not preferable because the chemical conversion coat having the adequate adhesion to a coating film cannot be attained. When it exceeds 500000, there is a possibility of inhibiting coat formation. More preferably, the above-mentioned lower limit is 5000 and the above-mentioned upper limit is 70000.

Preferably, the chemical conversion coating agent of the present invention further contains a chemical conversion reaction accelerator. The chemical conversion reaction accelerator has an effect of suppressing unevenness of the surface of a chemical conversion coat obtained using a metal surface treating agent comprising a zirconium compound. An amount of a coat precipitated is different depending on the difference of location between an edge portion and a flat portion of a material; thereby, the unevenness of the surface is generated. Therefore, when a metal material having an edge portion is treated with a conventional surface treating agent comprising a zirconium compound, since an anodic dissolution reaction occurs selectively at an edge portion, a cathodic reaction becomes prone to occur and, consequently, a coat tends to precipitate around the edge portion and an anodic dissolution reaction hardly occur in a flat portion and precipitation of a coat is suppressed, and this results in unevenness of the surface.

In the chemical conversion treatment of zinc phosphate, since the resulting chemical conversion coat is a thick film type, the unevenness of the surface does not turn into problems so much. However, since the chemical conversion coat comprising a zirconium compound is a thin film type, when a sufficient amount of a coat is not attained at a flat portion to which the chemical conversion treatment is hardly applied, this causes uneven coating and problems may arise in appearance of a coating and corrosion resistance.

The chemical conversion reaction accelerator in the present invention has a property to act in such a manner that the chemical conversion treatment may be applied without developing a difference of a chemical conversion treatment reaction between the edge portion and the flat portion described above by being blended in the chemical conversion coating agent.

Although the chemical conversion reaction accelerator is at least one kind selected from the group consisting of nitrite ions, nitro group-containing compounds, hydroxylamine sulfate, persulfate ions, sulfite ions, hyposulfite ions, peroxides, iron (III) ions, citric acid iron compounds, bromate ions, perchlorinate ions, chlorate ions, chlorite ions as well as ascorbic acid, citric acid, tartaric acid, malonic acid, succinic acid and salts thereof, in particular, a substance having an oxidizing action or an organic acid is preferable for accelerating etching efficiently.

By blending these chemical conversion reaction accelerators in the chemical conversion coating agent, unbalanced coat-precipitation is adjusted and good chemical conversion coat having no unevenness in an edge portion and a flat portion of a material can be attained.

A supply source of the nitrite ion is not particularly limited, and examples thereof include sodium nitrite, potassium nitrite, ammonium nitrite and the like. The nitro group-containing compound is not particularly limited, and examples thereof include nitrobenzenesulfonic acid, nitroguanidine and the like. A supply source of the persulfate ion is not particularly limited, and examples thereof include $Na_2S_2O_8$, $K_2S_2O_8$ and the like. A supply source of the sulfite ion is not particularly limited, and examples thereof include sodium sulfite, potassium sulfite, ammonium sulfite and the like. A supply source of the hyposulfite ion is not particularly limited, and examples thereof include sodium hyposulfite, potassium hyposulfite, ammonium hyposulfite and the like. The peroxides is not particularly limited, and examples thereof include hydrogen peroxide, sodium peroxide, potassium peroxide and the like.

A supply source of the iron (III) ion is not particularly limited, and examples thereof include ferric nitrate, ferric sulfate, ferric chloride and the like. The citric acid iron compound is not particularly limited, and examples thereof include citric acid iron ammonium, citric acid iron sodium, citric acid iron potassium and the like. A supply source of the bromate ion is not particularly limited, and examples thereof include sodium bromate, potassium bromate, ammonium bromate and the like. A supply source of the perchlorinate ion is not particularly limited, and examples thereof include sodium perchlorinate, potassium perchlorinate, ammonium perchlorinate and the like.

A supply source of the chlorate ion is not particularly limited, and examples thereof include sodium chlorate, potassium chlorate, ammonium chlorate and the like. A supply source of the chlorite ion is not particularly limited, and examples thereof include sodium chlorite, potassium chlorite, ammonium chlorite and the like. The ascorbic acid and salt thereof are not particularly limited, and examples thereof include ascorbic acid, sodium ascorbate, potassium ascorbate, ammonium ascorbate and the like. The citric acid and salt thereof are not particularly limited, and examples thereof include citric acid, sodium citrate, potassium citrate, ammonium citrate and the like. The tartaric acid and salt thereof are not particularly limited, and examples thereof include tartaric acid, ammonium tartrate, potassium tartrate, sodium tartrate and the like. The malonic acid and salt thereof are not particularly limited, and examples thereof include malonic acid, ammonium malonate, potassium malonate, sodium malonate and the like. The succinic acid and salt thereof are not particularly limited, and examples thereof include succinic acid, sodium succinate, potassium succinate, ammonium succinate and the like.

The above-described chemical conversion reaction accelerators may be used alone or in combination of two or more kinds of components as required.

A blending amount of the chemical conversion reaction accelerator in the chemical conversion coating agent of the present invention is preferably within a range from 1 ppm of a lower limit to 5000 ppm of an upper limit. When it is less than 1 ppm, it is not preferred because an adequate effect cannot be attained. When it exceeds 5000 ppm, there is a possibility of inhibiting coat formation. The above lower limit is more preferably 3 ppm and further more preferably 5 ppm. The above upper limit is more preferably 2000 ppm and further more preferably 1500 ppm.

Preferably, the chemical conversion coating agent of the present invention substantially contains no phosphate ions. Substantially containing no phosphate ions means that phosphate ions are not contained to such an extent that the phosphate ions act as a component in the chemical conversion coating agent. Since the chemical conversion coating agent of the present invention substantially contains no phosphate ions, phosphorus causing a burden on the environment is not substantially used and the formation of the sludge such as iron phosphate and zinc phosphate, formed in the case of using a treating agent of zinc phosphate, can be suppressed.

In the chemical conversion coating agent, preferably, a pH is within a range from 1.5 of a lower limit to 6.5 of an upper limit. When the pH is less than 1.5, etching becomes excessive; therefore, adequate coat formation becomes impossible. When it exceeds 6.5, etching becomes insufficient; therefore, a good coat cannot be attained. More preferably, the above lower limit is 2.0 and the above upper limit is 5.5. Still more preferably, the above lower limit is 2.5 and the above upper limit is 5.0. In order to control the pH of the chemical conversion coating agent, there can be used acidic compounds such as nitric acid and sulfuric acid, and basic compounds such as sodium hydroxide, potassium hydroxide and ammonia.

The chemical conversion coating agent of the present invention may be used in combination with an arbitrary component other than the above-mentioned components as required. Examples of the component which can be used include metal ions such as zinc ion, magnesium ion, calcium ion, aluminum ion manganese ion, iron ion, cobalt ion and copper ion, and silicon-containing compounds such as silica, water-dispersed silica, esters of silicic acid, and silane coupling agents and the like.

A chemical conversion treatment of metal using the chemical conversion coating agent is not particularly limited, and this can be performed by bringing a chemical conversion coating agent into contact with a surface of metal in usual treatment conditions. Preferably, a treatment temperature in the above-mentioned conversion treatment is within a range from 20° C. of a lower limit to 70° C. of an upper limit. More preferably, the above-mentioned lower limit is 30° C. and the above-mentioned upper limit is 50° C. Preferably, a chemical conversion time in the chemical conversion treatment is within a range from 5 seconds of a lower limit to 1200 seconds of an upper limit. More preferably, the above-mentioned lower limit is 30 seconds and the above-mentioned upper limit is 120 seconds. The treatment method is not particularly limited, and examples thereof include an immersion method, a spray coating method, a roller coating method and the like.

Examples of a metal material treated with the chemical conversion coating agent of the present invention include an iron material, an aluminum material, a zinc material and the like. Iron, aluminum and zinc materials mean an iron material in which a material comprises iron and/or its alloy, an aluminum material in which a material comprises aluminum and/or its alloy and a zinc material in which a material comprises zinc and/or its alloy, respectively. The chemical conversion coating agent of the present invention can also be used for chemical conversion treatment of a substance to be coated comprising a plurality of metal materials among the iron material, the aluminum material and the zinc material.

The chemical conversion coating agent of the present invention is preferable in point of being able to impart good adhesion to a coating film to iron materials to which it is hard to supply sufficient adhesion to a coating film by usual chemical conversion coating agents of zirconium and the like; therefore, it can also be applied for treating a substance which contains an iron material at least in part. Accordingly, the chemical conversion coating agent of the present invention has an excellent property particularly in application to iron materials.

The iron material is not particularly limited, and examples thereof include a cold-rolled steel sheet, a hot-rolled steel sheet and the like. The aluminum material is not particularly limited, and examples thereof include 5000 series aluminum alloy, 6000 series aluminum alloy and the like. The zinc material is not particularly limited, and examples thereof include steel sheets, which are plated with zinc or a zinc-based alloy through electroplating, hot dipping and vacuum evaporation coating, such as a galvanized steel sheet, a steel sheet plated with a zinc-nickel alloy, a steel sheet plated with a zinc-iron alloy, a steel sheet plated with a zinc-chromium alloy, a steel sheet plated with a zinc-aluminum alloy, a steel sheet plated with a zinc-titanium alloy, a steel sheet plated with a zinc-magnesium alloy and a steel sheet plated with a zinc-manganese alloy, and the like. By using the above chemical conversion coating agent, chemical conversion treatment with iron, aluminum and zinc materials can be conducted simultaneously.

Preferably, a coat amount of the chemical conversion coat attained by the chemical conversion coating agent of the present invention is within a range from 0.1 $mg/m^2$ of a lower limit to 500 $mg/m^2$ of an upper limit in a total amount of metals contained in the chemical conversion coating agent. When this coat amount is less than 0.1 $mg/m^2$, it is not preferable because a uniform chemical conversion coat cannot be attained. When it exceeds 500 $mg/m^2$, it is economically disadvantageous because further improvements of the performances cannot be obtained. More preferably, the above-mentioned lower limit is 5 $mg/m^2$ and the above-mentioned upper limit is 200 $mg/m^2$.

The surface of the metal material is preferably degreased before the chemical conversion treatment is applied using the chemical conversion coating agent; is rinsed with water after being degreased; and is postrinsed after the chemical conversion treatment.

The above-mentioned degreasing is performed to remove an oil matter or a stain adhered to the surface of the material, and an immersion treatment is performed usually at 30 to 55° C. for about several minutes with a degreasing agent such as phosphate-free and nitrogen-free cleaning liquid for degreasing. It is also possible to perform pre-degreasing before degreasing as required.

The above-mentioned rinsing with water after degreasing is performed by spraying once or more with a large amount of water for rinsing in order to rinse a degreasing agent after degreasing.

The above-mentioned postrinsing after the chemical conversion treatment is performed once or more in order to prevent the chemical conversion treatment from adversely affecting to the adhesion and the corrosion resistance after the subsequent various coating applications. In this case, it is appropriate to perform the final rinsing with pure water. In this postrinsing after the chemical conversion treatment, either spray rinsing or immersion rinsing may be used, and a combination of these rinsing methods may be adopted.

After the above-mentioned postrinsing after the chemical conversion treatment, the surface of the metal material is dried as required according to a publicly known method and then various coating can be performed.

In addition, since the chemical conversion treatment using the chemical conversion coating agent of the present invention does not need to perform a surface conditioning which is required in a method of treating using the zinc phosphate-based chemical conversion coating agent which is conventionally in the actual use, the chemical conversion treatment of metal can be performed in fewer steps.

The present invention is also directed to a surface-treated metal having the chemical conversion coat formed by the chemical conversion coating agent. The surface-treated metal of the present invention has the excellent adhesion between a coating film and the metal when a coating such as cationic electrocoating and powder coating is further applied on the above-mentioned chemical conversion coat. Coating which can be applied to the surface-treated metal of the present invention is not particularly limited, and examples thereof may include cationic electrocoating, powder coating and the like. Particularly, since the chemical conversion coating agent of the present invention can apply good treatment to all metals such as iron, zinc and aluminum, it can be favorably used as pretreatment of cationic electrocoating of a substance to be treated comprising, in at least a part thereof, an iron material. The cationic electrocoating is not specifically limited, and publicly known cationic electrodeposition coating composition comprising aminated epoxy resin, aminated acrylic resin, sulfonated epoxy resin and the like can be applied.

By containing at least one kind selected from the group consisting of zirconium, titanium and hafnium as a component constituting the chemical conversion coat and, further, by containing the water-soluble resin having a specific structure, the chemical conversion coating agent of the present invention can form the chemical conversion coat, which is high in the adhesion to a coating film, even for iron materials for which pretreatment by the conventional chemical conversion coating agents containing zirconium and the like are not suitable.

Since the chemical conversion coating agent of the present invention substantially contains no phosphate ions, the burden on the environment is less and the sludge is not formed. Further, the chemical conversion treatment using the chemical conversion coating agent of the present invention can perform the chemical conversion treatment of metal material in fewer steps since it does not require the steps of the surface conditioning.

Since the chemical conversion coating agent of the present invention does not substantially use harmful heavy metal compounds such as chromium and vanadium, and phosphate compounds, the burden on the environment is less and the sludge is not formed. In addition, the chemical conversion coating agent of the present invention can apply good treatment to all materials of iron materials, aluminum materials and zinc materials, and can form the chemical conversion coat which is high in the stability and the adhesion to a coating film as a coat. Further, the chemical conversion coating agent of the present invention is also excellent in that it can apply the surface treatment to a substance to be treated comprising a plurality of materials of the iron material, the aluminum material and the zinc material such as bodies and parts of automobiles.

EXAMPLES

Hereinafter, the present invention will be described in more detail by way of examples, but the present invention is not limited to these examples.

Example 1

A commercially available cold-rolled steel sheet (SPCC-SD, manufactured by Nippon Testpanel Co., Ltd., 70 mm×150 mm×0.8 mm) was used as a material, and pretreatment of coating was applied to the material in the following conditions.

(1) Pretreatment of Coating

Degreasing treatment: The metal material was immersed at 40° C. for 2 minutes with 2% by mass "SURF CLEANER 53" (degreasing agent manufactured by Nippon Paint Co., Ltd.).

Rinsing with water after degreasing: The metal material was rinsed for 30 seconds with a spray of running water.

Chemical conversion treatment: A chemical conversion coating agent, having 100 ppm of the zirconium concentration and 100 ppm of the resin concentration as a concentration of solid matter, was prepared by using fluorozirconic acid as a component constituting a coat and PVAM-0595B (polyvinylamine resin, molecular weight: 70,000, manufactured by Mitsubishi Chemical Co., Ltd.) as resin. A pH was adjusted to be 4 by using sodium hydroxide. The temperature of the chemical conversion coating agent was controlled at 40° C. and the metal material was immersed for 60 seconds. A coat amount at an initial stage of treatment was 10 mg/m$^2$.

Rinsing after chemical conversion treatment: The metal material was rinsed for 30 seconds with a spray of running water. Further, the metal material was rinsed for 30 seconds with a spray of ion-exchanged water.

Drying: The cold-rolled steel sheet after rinsing was dried at 80° C. for 5 minutes in an electrical dryer. It is noted that a coat amount was analyzed as the total amount of metals contained in the chemical conversion coating agent by using "XRF-1700" (X-ray fluorescence spectrometer manufactured by Shimadzu Co., Ltd.).

(2) Coating

After 1 m$^2$ of the surface of the cold-rolled steel sheet was treated per 1 liter of the chemical conversion coating agent, electrocoating was applied to the surface in such a manner that a dried film thickness was 20 μm using "POWERNIX 110" (a cationic electrodeposition coating composition manufactured by Nippon Paint Co., Ltd.) and, after rinsing with water, the metal materials were heated and baked at 170° C. for 20 minutes and test sheets were prepared.

Evaluation Test

<Observation of Sludge>

After 1 m$^2$ of the surface of the cold-rolled steel sheet was treated per 1 liter of the chemical conversion coating agent, haze in the chemical conversion coating agent was visually observed.

○: There is not haze

X: There is haze

<Secondary Adhesion Test (SDT)>

Two parallel lines, which have depth reaching the material, were cut in a longitudinal direction on the obtained test sheet and then the test sheet was immersed at 50° C. for 480 hours in 5% aqueous solution of NaCl. After immersion, a cut portion was peeled off with an adhesive tape and peeling of a coating was observed.

◎: No peeled

○: Slightly peeled

X: Peeled 3 mm or more in width

Results of observations are shown in Table 1.

Example 2

The test sheet was prepared by following the same procedure as that of Example 1 except that PAA-01 (polyallylamine resin, molecular weight: 1000, manufactured by Nitto Boseki Co., Ltd.) was used as the water-soluble resin and the concentration of the resin was changed to 500 ppm.

Example 3

The test sheet was prepared by following the same procedure as that of Example 1 except that PAA-10C (polyallylamine resin, molecular weight: 15000, manufactured by Nitto Boseki Co., Ltd.) was used as the water-soluble resin.

Example 4

The test sheet was prepared by following the same procedure as that of Example 1 except that PAA-H-10C (polyallylamine resin, molecular weight: 60000, manufactured by Nitto Boseki Co., Ltd.) was used as the water-soluble resin and the concentration of the resin was changed to 50 ppm.

Example 5

The test sheet was prepared by following the same procedure as that of Example 1 except that PAA-D-11HCl (polyallylamine copolymer, molecular weight: 70000, manufactured by Nitto Boseki Co., Ltd.) was used as the water-soluble resin and the concentration of the resin was changed to 50 ppm.

Example 6

The test sheet was prepared by following the same procedure as that of Example 1 except that PAA-H-10C was used as the water-soluble resin and the concentration of the resin was changed to 5 ppm.

Example 7

The test sheet was prepared by following the same procedure as that of Example 1 except that the concentration of zirconium was changed to 500 ppm, and PAA-01 was used as the water-soluble resin and the concentration of the resin was changed to 5000 ppm.

Example 8

The test sheet was prepared by following the same procedure as that of Example 1 except that the metal material was changed to galvanized steel sheet (GA steel sheet, manufactured by Nippon Testpanel Co., Ltd., 70 mm×180 mm×0.8 mm).

Example 9

The test sheet was prepared by following the same procedure as that of Example 1 except that the metal material was changed to 5000 series aluminum (manufactured by Nippon Testpanel Co., Ltd., 70 mm×180 mm×0.8 mm).

Example 10

The test sheet was prepared by following the same procedure as that of Example 1 except that degreasing is performed by using the "SURF CLEANER EC92" in place of "SURF CLEANER 53" and fluorozirconic acid, PAA-10C, zinc nitrate, commercially available silica (manufactured by Nissan Chemical Industries, Ltd.) and ascorbic acid as a chemical conversion reaction accelerator are blended in concentrations shown in Table 1 and the metal material was sent to a coating step as is wet without being dried. The concentrations of zinc nitrate and silica are the concentration as metal ions or as a silicon component.

Example 11

The test sheet was prepared by following the same procedure as that of Example 10 except that fluorozirconic acid, zinc nitrate, manganese nitrate, and sodium bromate as a chemical conversion reaction accelerator were blended in concentrations shown in Table 1 and a pH was adjusted to be 5.5 and the metal material was sent to a coating step after being air-dried.

Comparative Example 1

The test sheet was prepared by following the same procedure as that of Example 1 except that the water-soluble resin was not blended.

Comparative Example 2

The test sheet was prepared by following the same procedure as that of Example 1 except that the fluorozirconic acid was not blended.

Comparative Example 3

The test sheet was prepared by following the same procedure as that of Example 10 except that fluorozirconic acid and citric acid iron (III) ammonium were blended in concentrations shown in Table 1.

Comparative Example 4

The test sheet was obtained by following the same procedure as that of Example 1 except that the chemical conversion treatment was performed by conditioning the surface at room temperature for 30 seconds using "SURF FINE 5N-8M" (manufactured by Nippon Paint Co., Ltd.) after rinsing with water after degreasing and by immersing the test sheet at 35° C. for 2 minutes using "SURF DYNE SD-6350" (a zinc phosphate-based chemical conversion coating agent manufactured by Nippon Paint Co., Ltd.).

TABLE 1

| | | Material | Zirconium (ppm) | Resin | Resin concentration (ppm) | Zn (ppm) | Mg (ppm) | $SiO_2$ (ppm) | Chemical conversion reaction accelerator | Coat amount ($mg/m^2$) | Sludge | SDT |
|---|---|---|---|---|---|---|---|---|---|---|---|---|
| Example | 1 | SPC Steel sheet | 100 | PVAM-0595B | 100 | — | — | — | — | 38 | ○ | ○ |
| | 2 | SPC Steel sheet | 100 | PAA-01 | 500 | — | — | — | — | 37 | ○ | ○ |
| | 3 | SPC Steel sheet | 100 | PAA-10C | 100 | — | — | — | — | 39 | ○ | ◎ |
| | 4 | SPC Steel sheet | 100 | PAA-H-10C | 50 | — | — | — | — | 36 | ○ | ◎ |
| | 5 | SPC Steel sheet | 100 | PAA-D11-HCl | 50 | — | — | — | — | 38 | ○ | ◎ |
| | 6 | SPC Steel sheet | 100 | PAA-H-10C | 5 | — | — | — | — | 36 | ○ | ○ |
| | 7 | SPC Steel sheet | 500 | PAA-01 | 5000 | — | — | — | — | 63 | ○ | ○ |
| | 8 | GA Steel sheet | 100 | PVAM-0595B | 100 | — | — | — | — | 45 | ○ | ○ |
| | 9 | 5000 series aluminum | 100 | PVAM-0595B | 100 | — | — | — | — | 40 | ○ | ○ |
| | 10 | SPC Steel sheet | 250 | PAA-10C | 100 | 500 | — | 200 | Ascorbic acid (200 ppm) | 43 | ○ | ◎ |
| | 11 | SPC Steel sheet | 30 | PAA-10C | 100 | 100 | 100 | — | Sodium bromate (200 ppm) | 18 | ○ | ◎ |
| Compar. Ex. | 1 | SPC Steel sheet | 100 | — | — | — | — | — | — | 39 | ○ | x |
| | 2 | SPC Steel sheet | — | PVAM-0595B | 100 | — | — | — | — | 0 | ○ | x |
| | 3 | SPC Steel sheet | 250 | — | — | — | — | — | Citric acid iron (III) ammonium (0.5 ppm) | 25 | ○ | x |
| | 4 | SPC Steel sheet | | | Treatment by zinc phosphate | | | | | 2200 | x | ○ |

Table 1 shows that there was not the formation of sludge in the chemical conversion coating agent of the present invention. Further, it was shown that the chemical conversion coating agent of the present invention could form the chemical conversion coat having the good adhesion to a coating film in all metal materials. On the other hand, the chemical conversion coating agent obtained in Comparative Examples could not suppresses the formation of sludge and could not attain the chemical conversion coat which has excellent adhesion to a cationic electrodeposition coating film.

The invention claimed is:

1. A chemical conversion coating agent comprising:

at least one kind selected from the group consisting of zirconium, titanium and hafnium;

fluorine; and a water-soluble resin, wherein said water-soluble resin is a polyallylamine which is a homopolymer having a constituent unit expressed by the chemical formula (2):

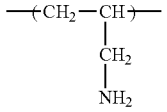

(2)

and wherein the water-soluble resin is a polyallylamine resin.

2. The chemical conversion coating agent according to claim 1, wherein the water-soluble resin has a molecular weight of 500 to 500000, and a content of the water-soluble resin in the chemical conversion coating agent is 5 to 5000 ppm.

3. The chemical conversion coating agent according to claim 2, containing 1 to 5000 ppm of at least one kind of a chemical conversion reaction accelerator selected from the group consisting of nitrite ion, nitro group-containing compounds, hydroxylamine sulfate, persulfate ion, sulfite ion, hyposulfite ion, peroxides, iron (III) ion, citric acid iron compounds, bromate ion, perchlorinate ion, chlorate ion, chlorite ion, as well as ascorbic acid, citric acid, tartaric acid, malonic acid, succinic acid and salts thereof.

4. The chemical conversion coating agent according to claim 3, wherein the at least one kind selected from the group consisting of zirconium, titanium and hafnium has a content of 20 to 10000 ppm in terms of metal, and the chemical conversion coating agent has a pH of 1.5 to 6.5.

5. The chemical conversion coating agent according to claim 2, wherein the at least one kind selected from the group consisting of zirconium, titanium and hafnium has a content of 20 to 10000 ppm in terms of metal, and the chemical conversion coating agent has a pH of 1.5 to 6.5.

6. The chemical conversion coating agent according to claim 2, containing 1 to 5000 ppm of at least one kind of a chemical conversion reaction accelerator selected from the group consisting of nitrite ion, nitro group-containing compounds, hydroxylamine sulfate, persulfate ion, sulfite ion, hyposulfite ion, peroxides, iron (III) ion, citric acid iron compounds, bromate ion, perchlorinate ion, chlorate ion, chlorite ion, as well as ascorbic acid, citric acid, tartaric acid, malonic acid, succinic acid and salts thereof.

7. The chemical conversion coating agent according to claim 6, wherein the at least one kind selected from the group consisting of zirconium, titanium and hafnium has a content of 20 to 10000 ppm in terms of metal, and the chemical conversion coating agent has a pH of 1.5 to 6.5.

8. The chemical conversion coating agent according to claim 1, wherein the at least one kind selected from the group consisting of zirconium, titanium and hafnium has a content of 20 to 10000 ppm in terms of metal, and the chemical conversion coating agent has a pH of 1.5 to 6.5.

9. The chemical conversion coating agent according to claim 1 which is Substantially free from phosphate ions.

10. The chemical conversion coating agent according to claim 9 which comprises zirconium.

11. The chemical conversion coating agent according to claim 9 for obtaining a chemical conversion coating film by rinsing with water after chemical conversion coating treatment.

12. The chemical conversion coating agent according to claim 1 for manufacturing automobile bodies and parts.

* * * * *